US006523487B2

(12) United States Patent
Hattori et al.

(10) Patent No.: US 6,523,487 B2
(45) Date of Patent: Feb. 25, 2003

(54) HEADGEAR FRAME APPARATUS

(75) Inventors: Osamu Hattori, Ichinomiya (JP); Masahiko Ozeki, Ichinomiya (JP)

(73) Assignee: Kabushikikaisha Barudan, Ichinomiya (JP)

( * ) Notice: Subject to any disclaimer, the term of this patent is extended or adjusted under 35 U.S.C. 154(b) by 39 days.

(21) Appl. No.: 09/903,856

(22) Filed: Jul. 13, 2001

(65) Prior Publication Data

US 2002/0020330 A1 Feb. 21, 2002

(30) Foreign Application Priority Data

Jul. 13, 2000 (JP) ..... 2000-212283

(51) Int. Cl.[7] ..... D05C 9/04
(52) U.S. Cl. ..... 112/103; 112/470.18
(58) Field of Search ..... 112/103, 470.06, 112/470.09, 470.14, 475.11, 63, 470.18

(56) References Cited

U.S. PATENT DOCUMENTS 6,273,012 B1 * 8/2001 Hattori et al. ..... 112/103
6,279,498 B1 * 8/2001 Hattori et al. ..... 112/103

* cited by examiner

*Primary Examiner*—Peter Nerbun
(74) *Attorney, Agent, or Firm*—Pillsbury Winthrop LLP

(57) ABSTRACT

A headgear frame apparatus adapted to be removably attached to a drive frame adapted to be driven transversely and longitudinally of a sewing machine and extending transversely. The headgear frame apparatus comprises: a mounting base frame attached removably to the front side of the drive frame and adapted to be driven transversely and longitudinally together with the drive frame; a support frame connected to the mounting base frame such that it is driven with the mounting base frame longitudinally but not transversely; a rotary frame supported rotatably on the support frame; a headgear frame fitted removably on the rotary frame for clamping a headgear; and a rotation converting member interposed between the mounting base frame and the rotary frame for converting the transverse motions of the mounting base frame into rotations of the rotary frame. The mounting base frame includes a guide face confronting a drive frame front face of the drive frame from the front and extending transversely. One or more front bearing roller for abutting against the guide face and one or more rear bearing roller for abutting against the drive frame front face are rotatably borne on the support frame respectively.

7 Claims, 8 Drawing Sheets

HEADGEAR FRAME APPARATUS

BACKGROUND OF THE INVENTION

1. Field of the Invention

The present invention relates to a headgear frame apparatus attached removably to the drive frame of a sewing machine for clamping a headgear.

2. Description of Related Art

As shown in FIGS. 6 and 7, a headgear frame apparatus 105 of the prior art is provided with: a headgear frame 100 for clamping a headgear 1; a rotary drive frame 106 for fitting the headgear frame 100 replaceably on the sewing machine side; a support frame 109 for supporting the rotary drive frame 106 turnably; and a guide plate 110 fixed on the support frame 109 and extending to the side of a cylindrical bed 111 of the sewing machine.

When this headgear frame apparatus 105 is to be attached to a drive frame 112 of the sewing machine, a mounting bracket 113 is fixed on the upper face of the drive frame 112. On the back face of the bracket 113, there is mounted a rotationally driving slide rail 114 having a rail groove 114*a*, to which the support frame 109 is connected through a bearing roller 115.

In the headgear frame apparatus 105 thus far described, it is simple to attach the support frame 109, however a clearance 116 never fails to be formed between the rail groove 114*a* and the bearing roller 115 so that it causes a longitudinal looseness exerting an adverse affect on the embroidering quality. At a high speed run (e.g., at 750 rpm), moreover, the support frame 109 or the headgear frame 100 vibrates to cause a frequent breakage of the needle or an unsatisfactory embroidery finish.

Therefore, the present inventors have proposed an improvement (Japanese Patent Application No. 11-106172, although not opened at the time of this application), as shown in FIG. 8. In this proposal, the support frame 109 is constructed of a front member 205 positioned on the front side of the drive frame 112, and a rear member 206 positioned on the rear side of the drive frame 112. Moreover, a front bearing roller 208 mounted rotatably on the front member 205 and a rear bearing roller 207 mounted rotatably on the rear member 206 clamp the drive frame 112 longitudinally, and the front member 205 and the rear member 206 are jointed by inserted and fastened a joint screw 210, as threaded in one of them, into a U-shaped groove 209 formed in the other. This structure has succeeded in eliminating the looseness of the support frame 109 or the headgear frame 100 to solve the above-specified problem.

When the headgear frame apparatus 105 of the proposal is to be attached to the drive frame 1112, however, the operator is required to manipulate the rear member 206 to below or backward of the drive frame 112 and to join the front member 205 and the rear member 206 while applying the rear bearing roller 208 to the rear face of the drive frame 112. This is a work at a rather backward deep position, as viewed from the front of the headgear frame apparatus 105 while groping, thus leaving a problem of poor workability.

SUMMARY OF THE INVENTION

An object of the present invention is to provide a headgear frame apparatus which can solve the above-specified problems and can be attached easily without any looseness to the drive frame of a sewing machine.

According to the present invention, there is provided a headgear frame apparatus adapted to be removably attached to a drive frame adapted to be driven transversely and longitudinally of a sewing machine and extending transversely, comprising: a mounting base frame attached removably to the front side of the drive frame and adapted to be driven transversely and longitudinally together with the drive frame; a support frame connected to the mounting base frame such that it is driven with the mounting base frame longitudinally but not transversely; a rotary frame supported rotatably on the support frame; a headgear frame fitted removably on the rotary frame for clamping a headgear; and a rotation converting member interposed between the mounting base frame and the rotary frame for converting the transverse motions of the mounting base frame into rotations of the rotary frame, wherein the mounting base frame includes a guide face confronting the drive frame front face of the drive frame from the front and extending transversely, and wherein one or more front bearing roller for abutting against the guide face and one or more rear bearing roller for abutting against the drive frame front face are rotatably borne on the support frame respectively.

It is preferred that there is further comprised roller span adjusting means for holding the front bearing roller and the rear bearing roller with their pivot pins having a longitudinal span expanded, to bring the front bearing roller and the rear bearing roller individually into abutment without any looseness against the guide face and the drive frame front face.

The roller span adjusting means should not be limited to a specific structure but can be exemplified by the following modes i) and ii).

i) The mode in which the roller span adjusting means includes: an adjusting lever supporting the pivot pin of the front bearing roller or the rear bearing roller and hinged turnably to the support frame; and lever holding members for stopping and holding the adjusting lever at the rotation adjusted position on the support frame. It is preferred that the adjusting lever is so disposed that it can be manipulated by an operator from the front of the headgear frame apparatus.

ii) The mode in which the roller span adjusting means is one or more spring for urging both or one of the pivot pins of the front bearing roller and the rear bearing roller in a direction to expand the longitudinal span of the both pivot pins.

There can be exemplified the mode, in which one of the front bearing roller and the rear bearing roller is provided by one whereas the other is provided by two or more; or the mode in which both of them are provided by two or more respectively.

Further objects of this invention will become evident upon an understanding of the illustrative embodiments described below. Various advantages not specifically referred to herein but within the scope of the instant invention will occur to one skilled in the art upon practice of the presently disclosed invention. The following examples and embodiments are illustrative and not seen to limit the scope of the invention.

DETAILED DESCRIPTION OF THE PREFERRED EMBODIMENT

An embodiment of a headgear frame apparatus embodying the invention will be described with reference to FIGS. 1 to 5. This headgear frame apparatus 9 is removably attached to a drive frame 60 of a sewing machine to clamp a headgear 1 to support the embroidering range of the headgear 1 in a proper mode.

Figure 1:
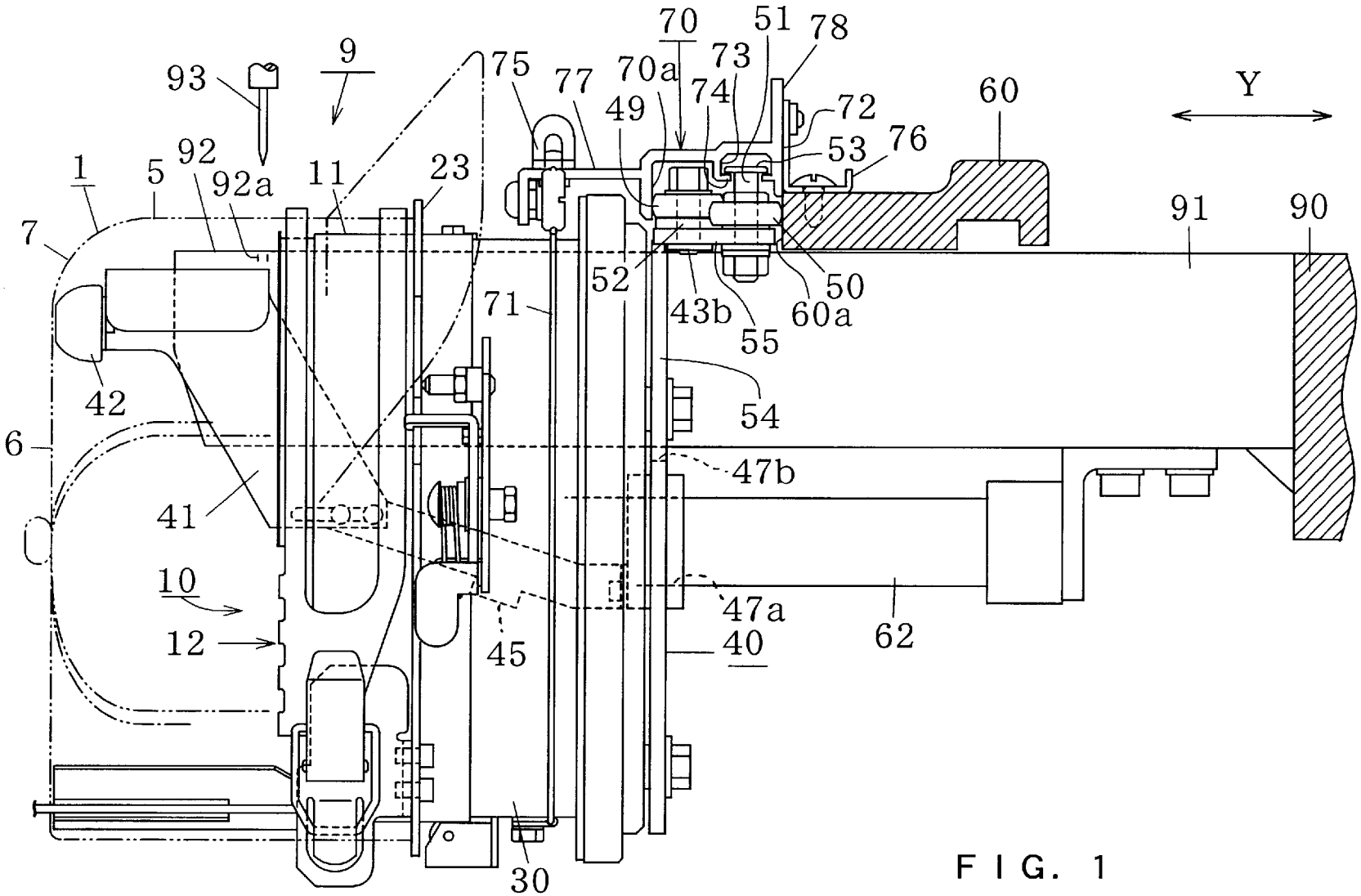
FIG. 1 is a righthand side elevation showing a headgear frame apparatus for a sewing machine according to an embodiment of the invention.
Figure 2:
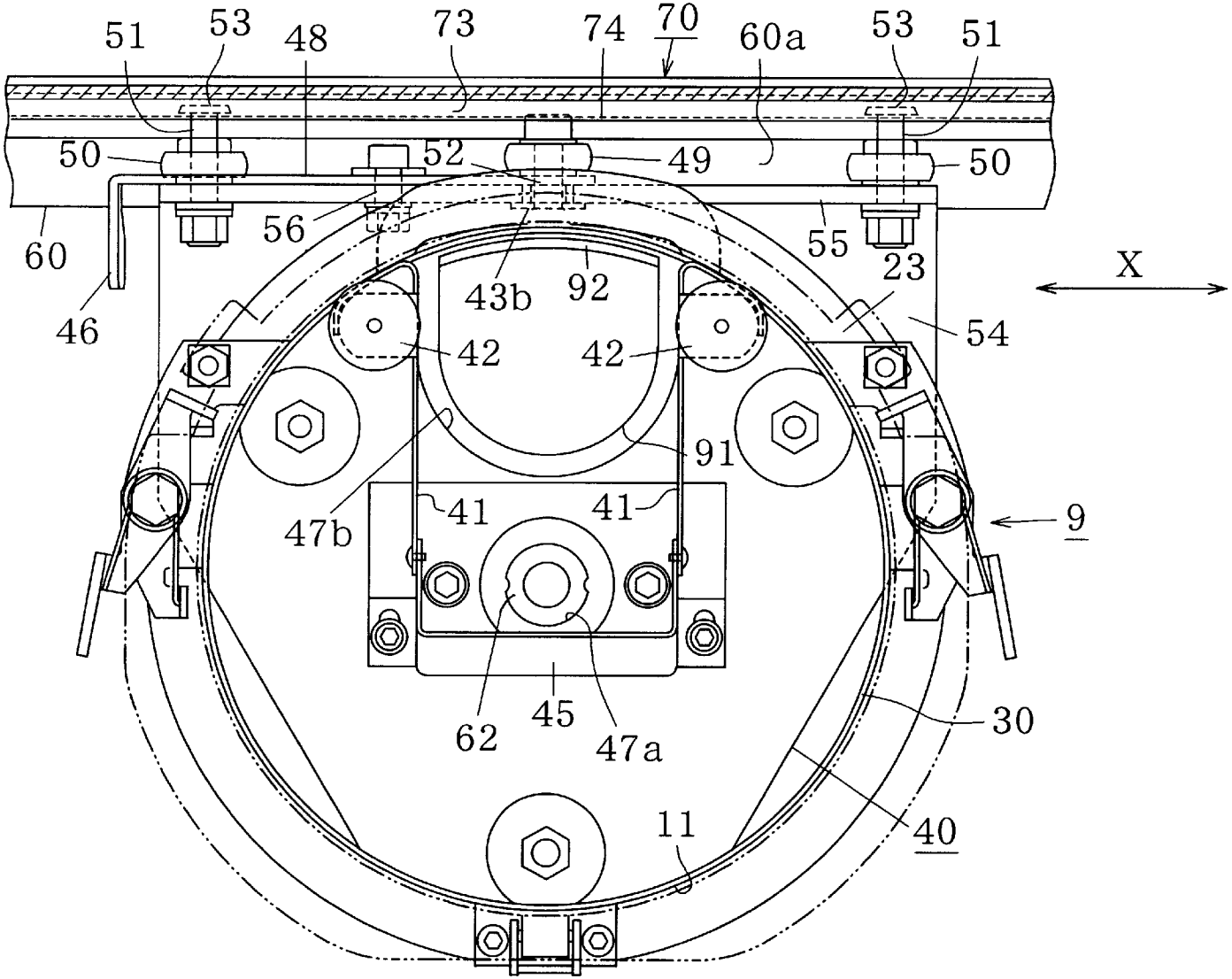
FIG. 2 is a front elevation of the same headgear frame apparatus.

The description on the body of the sewing machine will be restricted on the portions relating to the headgear frame apparatus 9. As shown in FIG. 1, there is provided a cylindrical bed 91 which is protruded forward from a machine frame 90. On the upper face of the leading end side of the cylindrical bed 91, there is arranged a needle plate 92 having a needle hole 92*a,* below which there is mounted a (not-shown) rotating hook having bobbin thread wound thereon. Over the cylindrical bed 91, on the other hand, there is disposed a needle 93 which has a needle thread passed therethrough and which is driven up and down by a (not-shown) machine head. By the co-actions between the needle 93, as driven on the basis of embroidering data, and the aforementioned rotating hook, moreover, there is embroidered the headgear 1 which is held in the headgear frame apparatus 9 Below the base end side of the cylindrical bed 91, there is protruded in parallel a guide rail 62 which supports a later-described support frame 40 of the headgear frame apparatus 9 movably in Y-directions.

Just over the cylindrical bed 91, on the other hand, there 15 is disposed the drive frame 60 which is extended in X-directions (or transverse directions) of the sewing machine so that it is driven in the Y-directions (or the longitudinal directions) and in the X-directions (or the transverse directions) by the (not-shown) drive source. The drive frame 60 has a front face 60*a* providing a vertical face extending in the X-directions.

Now, the headgear frame apparatus 9 is provided with: a mounting base frame 70 attached removably to the front side of the drive frame 60 so that it is driven together with the drive frame 60 in the XY directions; the support frame 40 connected to the mounting base frame 70 so that it is driven together with the mounting base frame 70 in the Y-directions but not in the X-directions; a rotary frame 30 supported rotatably on the support frame 40; a wire 71 acting as a rotation converting member interposed between the mounting base frame 70 and the rotary frame 30 for converting the transverse motions of the mounting base frame 70 into the rotations of the rotary frame 30; and a headgear frame 10 fitted replaceably on the rotary frame 30 for clamping the headgear 1.

The mounting base frame 70 is exemplified by an extruded member extending in the X-direct ions in parallel with the drive frame 60. The mounting base frame 70 is composed, in the recited order from the back side to the front side, of: a back wall 72 attached to the drive frame 60; an engagement groove 73 including a suspending portion 74 which has a generally C-shaped section opened downward and which is folded at its open end to confront each other; a guide face 70*a* confronting a front face 60*a* of the drive frame 60 (it will be referred to as drive face front face 60*a*" hereafter) from the front and extending in the transverse directions; and a wire mounting portion 77.

With the right and left ends of the back wall 72, there are integrally formed mounting portions 78 which protrude vertically upward, so that a mounting member 76 having an L-shaped section is applied and screwed individually to the mounting portions 78 and the upper face of the drive frame 60 so that the mounting base frame 70 is removably mounted on the, front side of the drive frame 60. By this mounting structure, the back face of the back wall 72 and the drive frame front face 60*a* are flush with each other. The support frame 40 is provided with a vertical wall 54 and horizontal wall 55 extending horizontally from the upper end of the vertical wall 54 to the back side. In the vertical wall 54, there are formed a guide hole 47*a,* into which the guide rail 62 is inserted relatively slidably in the Y-directions, and a bed hole 47*b* in which the cylindrical bed 91 is fitted. The horizontal wall 55 is located below the mounting base frame 70. In the vicinity of the right and left ends of the horizontal wall 55, there are erected back pivot pins 51 which are individually located just below the engagement groove 73 and which are provided with flanged engagement portions 53 at their individual upper ends. These engagement portions 53 are inserted to engage with the engagement groove 73 such that they are allowed to move transversely relative to the suspended portion 74 but not to come out, thereby to join the mounting base frame 70 and the support frame 40 integrally.

Figure 3:
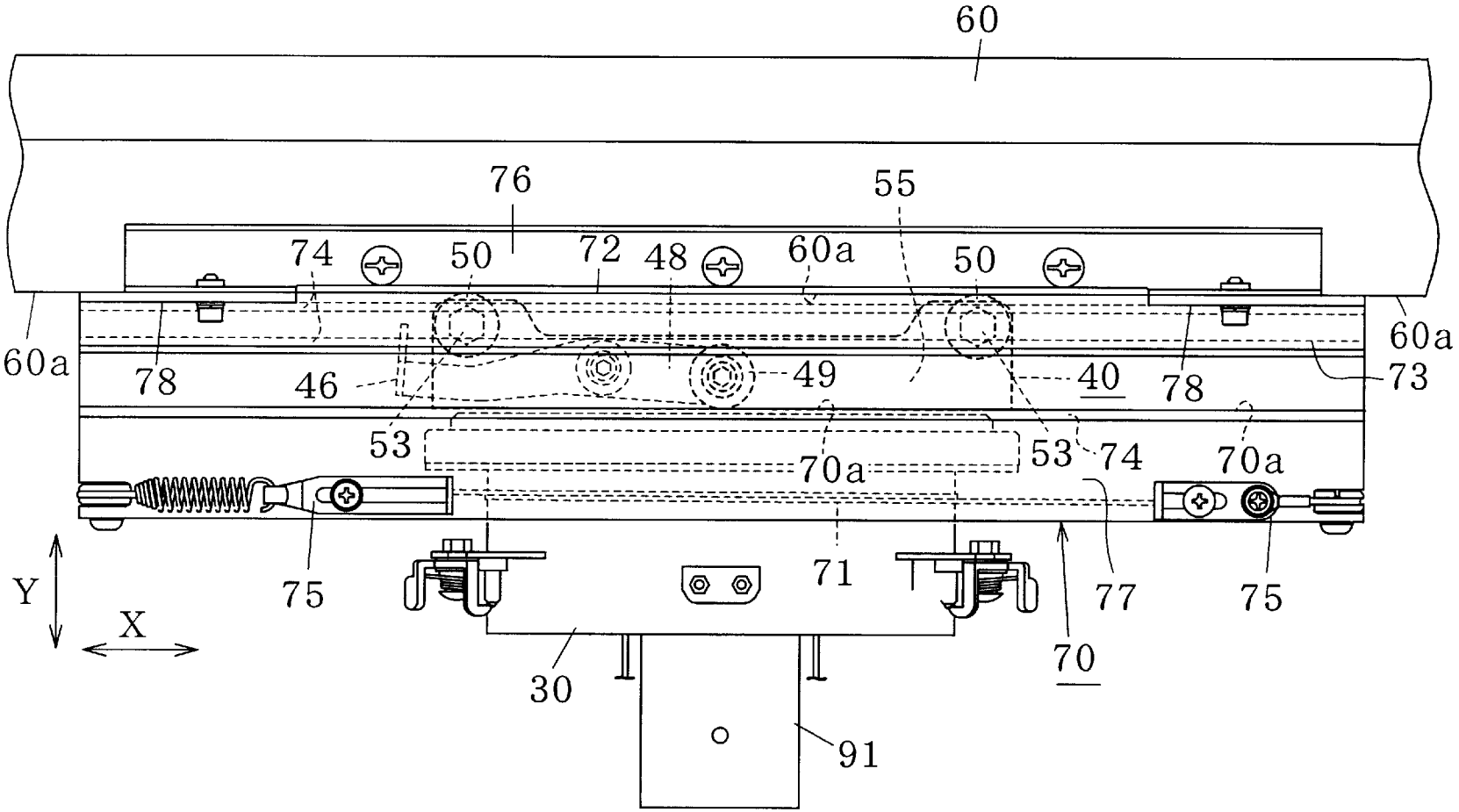
FIG. 3 is a top plan view of the same headgear frame apparatus.
Figure 4:
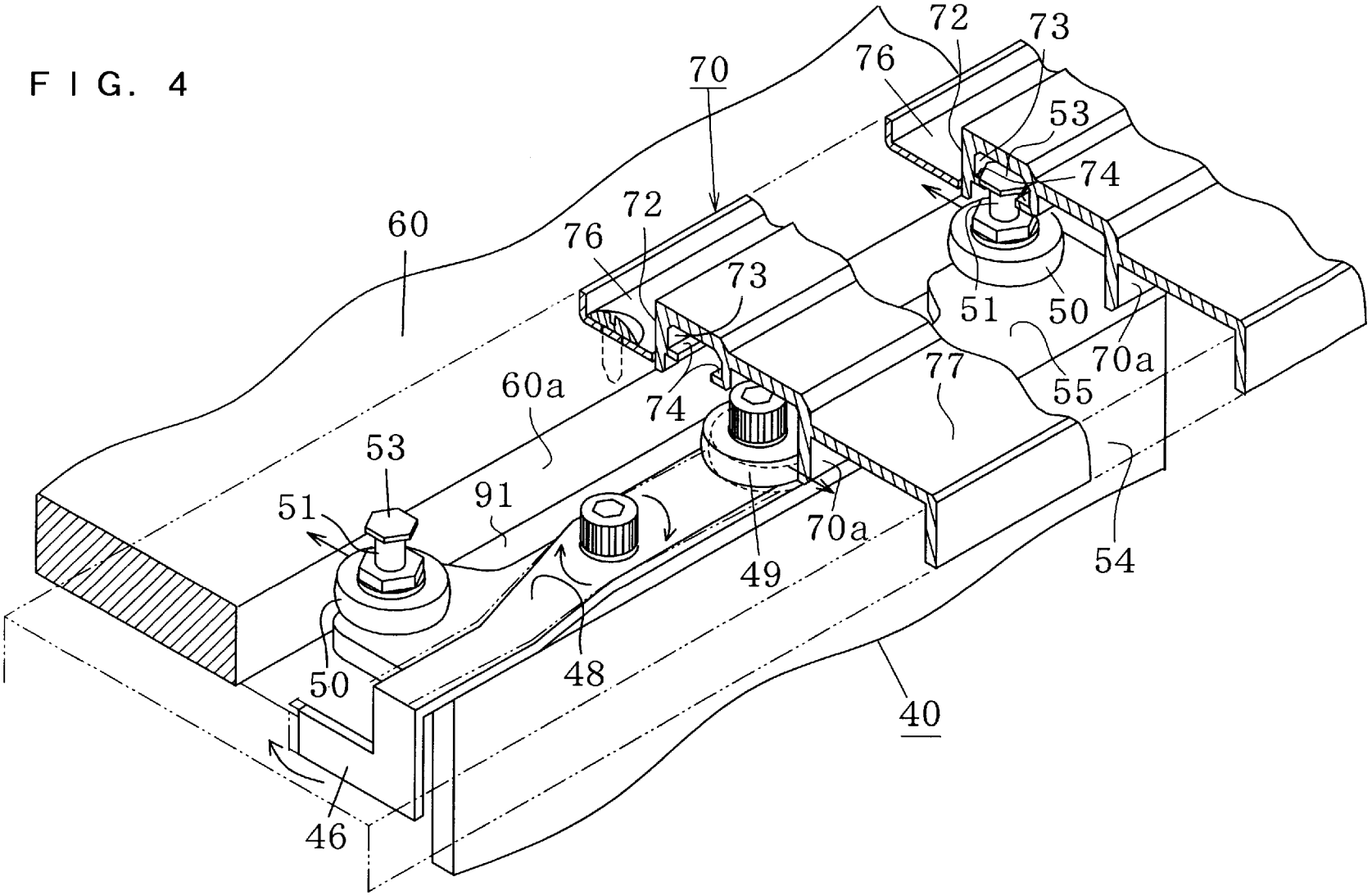
FIG. 4 is a perspective view of the vicinity of a mounting base frame of the same headgear frame apparatus.

In order to connect the support frame 40 to the drive frame 60 without any looseness, on the other hand, the horizontal wall 55 is provided, as shown in FIGS. 1, 3 and 4, with one front bearing roller 49 and two rear bearing rollers 50 in a horizontal plane. These rear bearing rollers 50 are pivotally supported turnably on the lower portion of the rear pivot pins 51 while abutting against the drive frame front face 60*a.*

Figure 5:
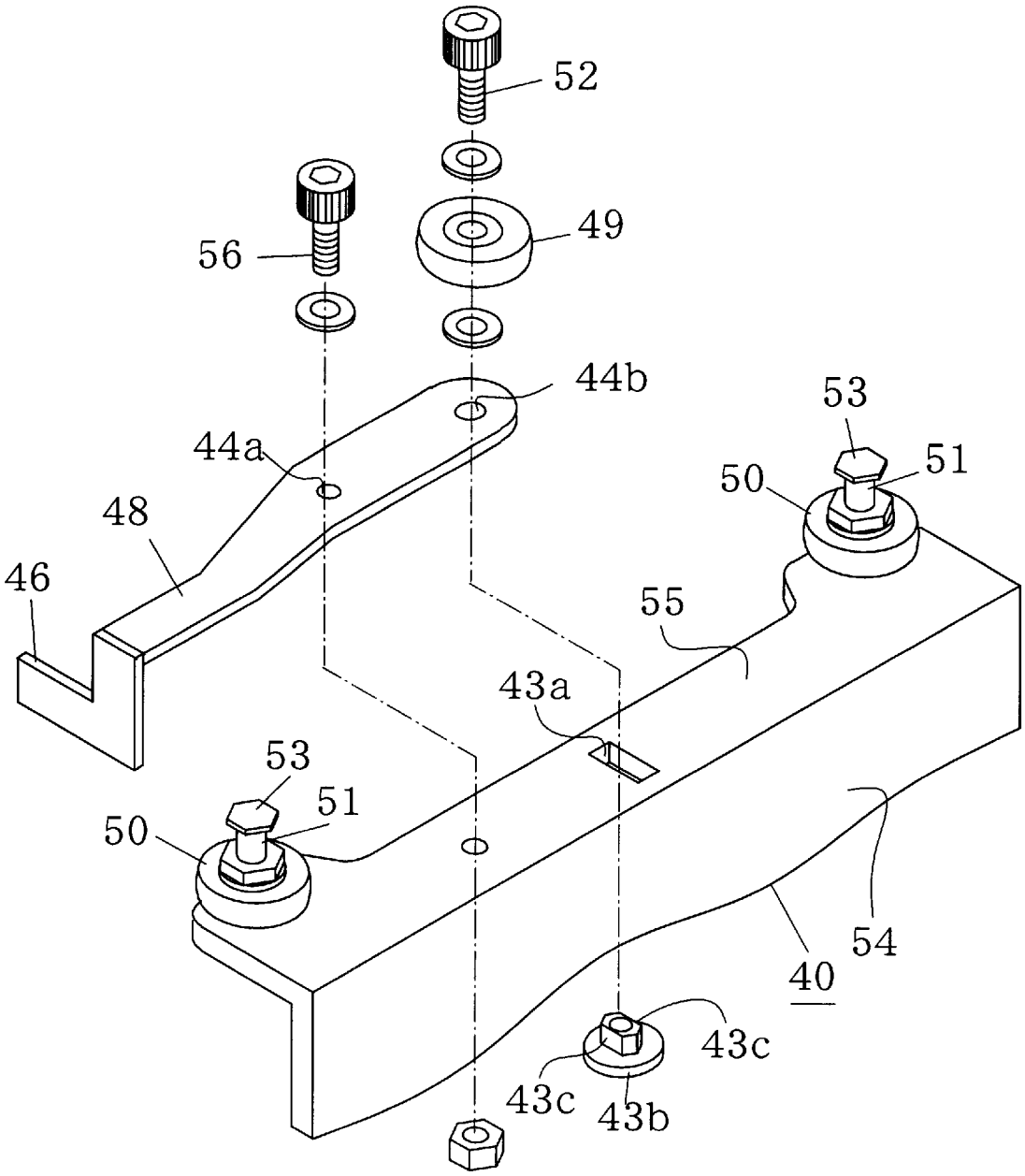
FIG. 5 is an exploded perspective view showing a structure of a roller span adjusting means of the same headgear frame apparatus.
Figure 6:
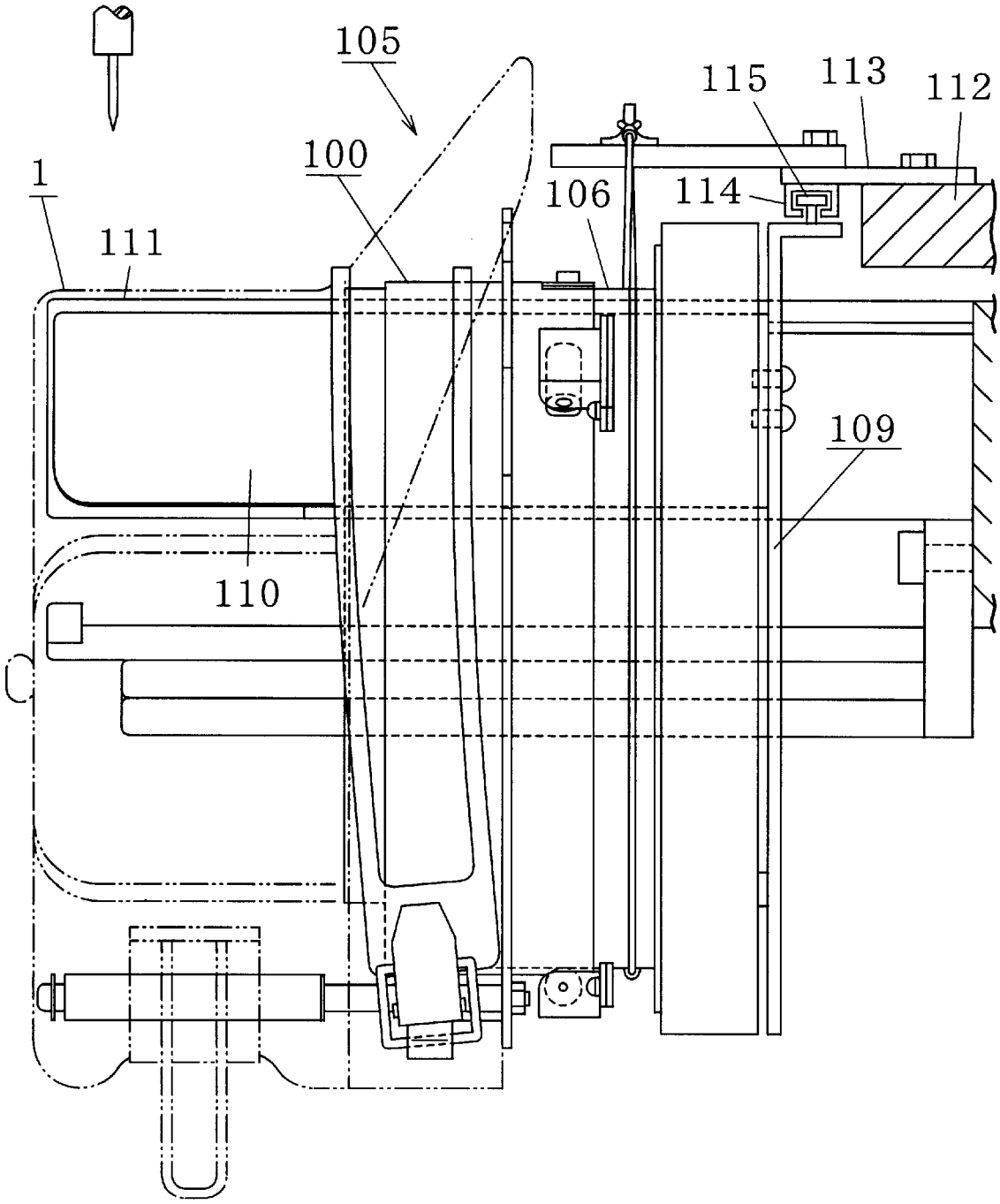
FIG. 6 PRIOR ART
FIG. 6 is a righthand side elevation showing a headgear frame apparatus of the prior art.
Figure 7:
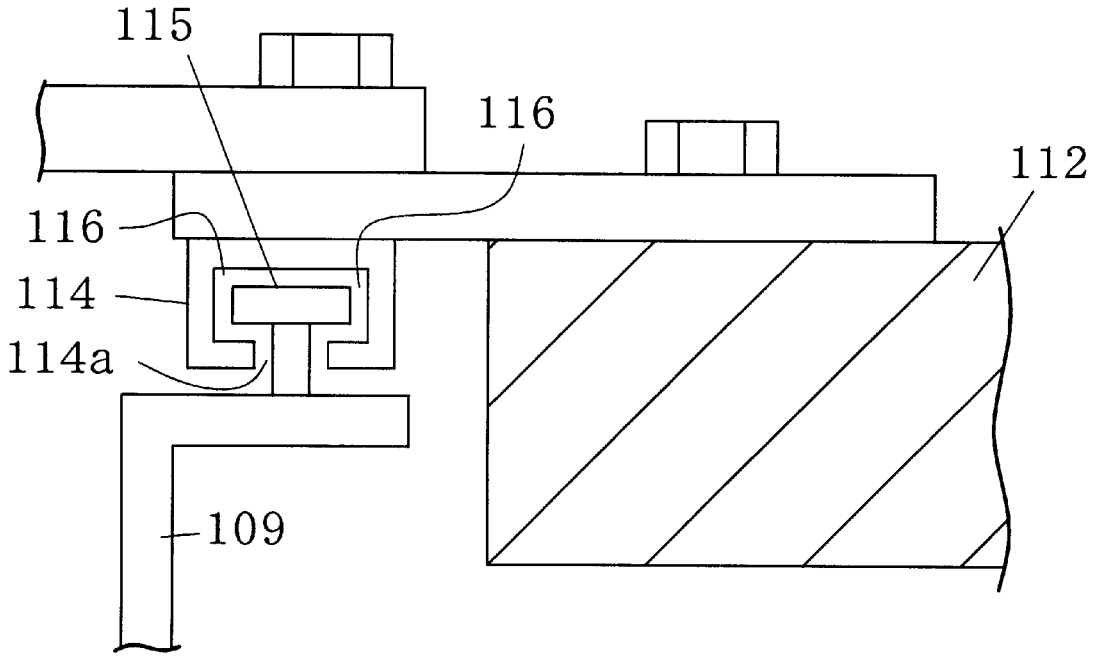
FIG. 7 PRIOR ART
FIG. 7 is an enlarged view of a portion of FIG. 6.
Figure 8:
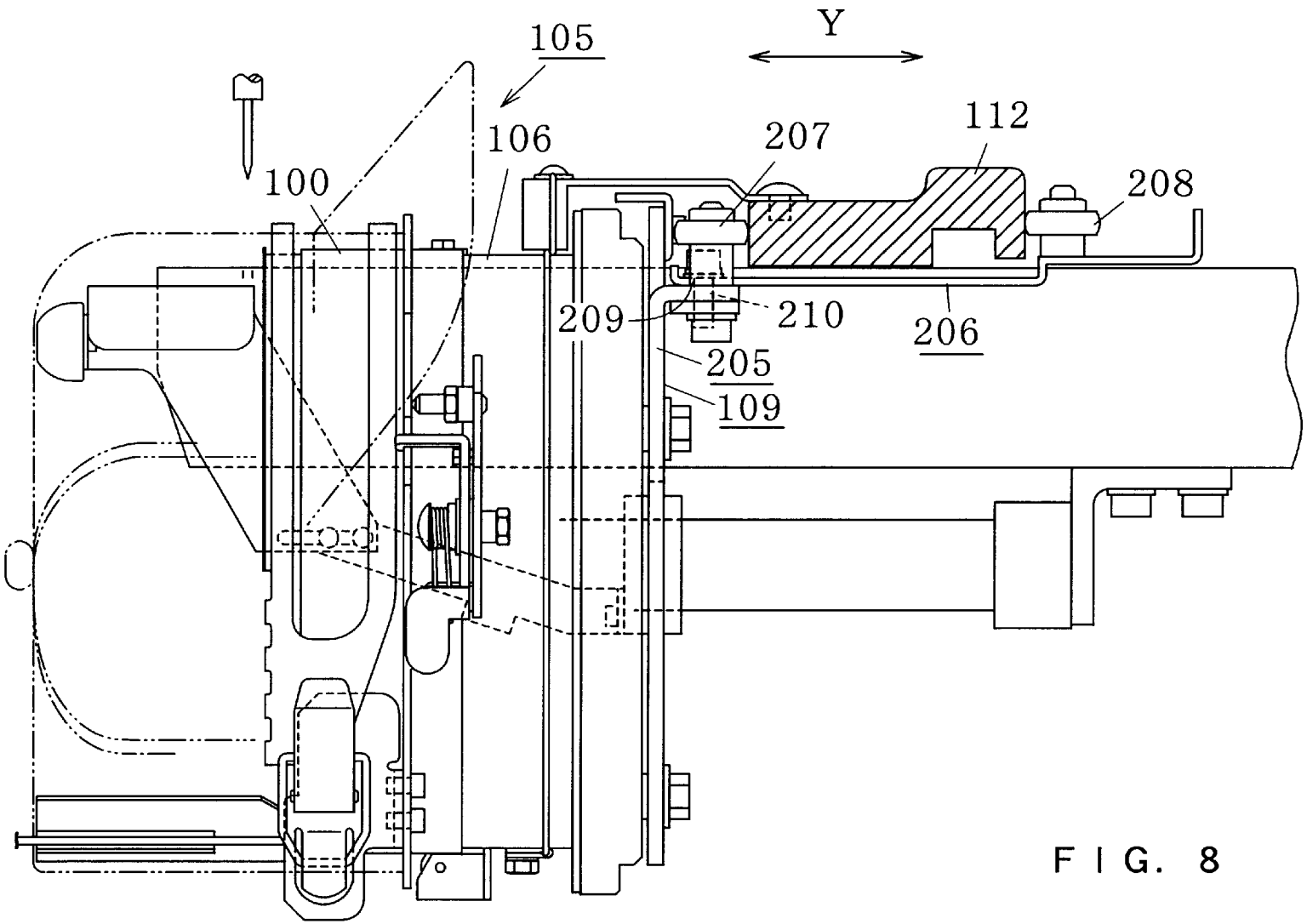
FIG. 8 is a righthand side elevation showing an improved proposal of the headgear frame apparatus of FIG. 6.

On the other hand, the front bearing roller 49 is pivotally supported on a front pivot pin 52 (as located at the central portion in the X-directions of the horizontal wall 55) which is erected from one end portion of an adjusting lever 48 hinged turnably to the support frame 40, while abutting against the guide face 70*a.* The adjusting lever 48 will be described in detail with reference to FIGS. 4 and 5. The adjusting lever 48 is provided, at its one end portion, with a axial hole 44*b* for passing a bolt as the front pivot pin 52 therethrough, at its intermediate portion, with a fulcrum hole 44*a* as a fulcrum for the turning motions and, at its other end portion extending sideway from the side face of the horizontal wall 55, with a finger hook 46. Here, the adjusting lever 48 is shaped not to abut against the rear bearing rollers 50.

Just below the front bearing roller 49 of the horizontal wall 55, there is formed an adjusting hole 43*a* which is longitudinally extended into a rectangular shape. In this adjusting hole 43*a,* there is so fitted an adjusting nut 43*b* that its parallel outer faces 43*c* can slide longitudinally. The front pivot pin 52 or the bolt is screwed in the internally threaded hole of the adjusting nut 43*b.* As the front pivot pin 52 (or bolt) and the adjusting nut 43*b* are loosened, the adjusting nut 43*b* and the front pivot pin 52 can be displaced within the range of the longitudinal length of the adjusting hole 43*a* so that the adjusting lever 48 can be turned by a small angle within the same range. If the front pivot pin 52 (or bolt) and the adjusting nut 43*b* are fastened, on the other hand, the adjusting lever 48 can be stopped and held at the adjusted position in the support. frame 40.

The adjusting lever 48, and the front pivot pin 52 (or bolt) and the adjusting nut 43*b* for the lever holding member construct altogether roller span adjusting means for bringing the front bearing roller 49 and the rear bearing rollers 50 individually into abutment against the guide fade 70*a* and the drive frame front face 60*a* without any looseness while holding them with the longitudinal span between the both pivot pins 52 and 51 of the front bearing roller 49 and the rear bearing rollers 50 being expanded.

The adjusting lever 48 is protruded at its other end portion sideway from the side face of the horizontal wall 55 and is provided with the finger hook 46 at its other end portion so that it can be easily manipulated by the operator from the front of the headgear frame apparatus 9.

With the construction thus; far described, the one front bearing roller 49 and the two rear bearing rollers 50 abut without any looseness against the guide faces 70*a* and the front face 60*a* from the inner side thereby to make the so-called "three-point support".

Next, the wire 71 acting as the rotation converting member is wound by, for example, one to three turns on the outer circumference of the rotary frame 30 and is crossed at its two end portions over that outer circumference. After this crossing, the two extending ends are attached to the right and left end portions of the wire mounting portion 77 of the mounting base frame 70 through wire mounting members: 75.

The headgear frame 10 is provided, as shown in FIG. 1, with a cylindrical receiving frame 11 to be inserted into the headgear 1, and a holding band 12 to be wound on the outer side of the headgear 1 to clamp the headgear 1 between itself and the receiving frame 11. Here, a stay 45, as protruded forward from the support frame 40, is provided with elastic plates 41 which are extended as far as the sides of the cylindrical bed 91. On the leading ends of the elastic plates 41, there are rotatably mounted auxiliary rollers 42 which can rotate in abutment against a boundary corner portion 7 between a peripheral portion 5 and a crest portion 6 of the headgear 1 clamped by the headgear frame 10.

In the headgear frame apparatus 9 of this embodiment, the mounting base frame 70, the support frame 40, the rotary frame 30 and the wire 71 are so united as not to come out of one another.

The headgear frame apparatus 9 thus constructed is attached to the drive frame 60 of the sewing machine in the following manners.

First of all, the guide rail 62 is inserted into the guide hole 47*a* of the support frame 40, and the cylindrical bed 91 is inserted into the bed hole 47*b* so that the support frame 40 and the mounting base frame 70 are positioned just in front of the drive frame 60. The back wall 72 of the mounting base frame 70 is attached to the drive frame 60 by means of the mounting member 76.

Next, the finger hook 46 is manipulated by a finger from the front of the headgear frame apparatus 9 to turn the adjusting lever 48 by a small angle on the fulcrum hole 44*a*. The front pivot pin 52 of the front bearing roller 49; is displaced forward to expand the longitudinal span between the both pivot pins 52 and 51 of the front bearing roller 49 and the rear bearing rollers 50. Then, the front bearing roller 49 and the rear bearing rollers 50 come into abutment without any looseness against the guide face 70*a* and the drive frame front face 60*a* from the inner side. In this state, the front pivot pin 52 (or bolt) and the adjusting nut 43*b* may be fastened to stop and hold the adjusting lever 48 at the adjusted position on the support frame 40.

The following effects can be achieved according to the headgear frame apparatus 9 of this embodiment.

(a) The longitudinal drive force of the headgear frame 10 is applied directly from the drive frame 60 but without any looseness so that the longitudinal vibration of the headgear frame 10 is reduced at a high speed (e.g., 800 rpm).

(b) With this reduced vibration at the high speed, the longitudinal out-of-step of the headgear frame 10 is suppressed to make it possible to embroider at a high speed and to finish a beautiful embroidered pattern.

(c) The mounting base frame 70 is provided with the guide face 70*a* confronting the drive frame front face 60*a* from the front and extending transversely. Furthermore, the front bearing roller 49 to abut against the guide face 70*a* and the rear bearing rollers 50 to abut against the drive frame front face 60*a* are borne on the support frame 40. When the headgear frame apparatus 9 is to be mounted on the drive frame 60, therefore, the operator may handle the individual members such as the mounting base frame 70, the adjusting lever 48 and the front pivot pin 52 (or bolt) within an easy reach from the front of the headgear frame apparatus 9. Therefore, the mounting workability is so excellent that no work is required in the rear deep position unlike the foregoing improved proposal.

Here, the invention should not be limited to the aforementioned construction of the embodiment but can also be suitably modified and embodied within the scope thereof, as exemplified in the following.

(1) In a modification of the roller span adjusting means, between the other end portion (although the finger hook 46 is omitted) of the adjusting lever 48 and the horizontal wall 55, a spring is interposed for urging the front pivot pin 52 of the front bearing roller 49 always forward (i.e., in the direction to expand the longitudinal span of the both pivot pins of the front bearing roller 49 and the rear bearing rollers 50). On the other hand, the adjusting lever 48 is omitted and the lever holding member 43 is provided with a spring for urging the front pivot pin 52 forward. By using such a spring, there is omitted the labor for the operator to manipulate the adjusting lever 48.

(2) There are provided two front bearing rollers 49 and one rear bearing roller 50. Alternatively, there are provided two or more front bearing rollers 49 and rear bearing rollers 50 respectively.

As many apparently widely different embodiments of this invention may be made without departing from the spirit and scope thereof, it is to be understood that the invention is not limited to the specific embodiments thereof except as defined in the appended claims.

What is claimed is:

1. A headgear frame apparatus adapted to be removably attached to a drive frame adapted to be driven transversely and longitudinally of a sewing machine and extending transversely, comprising:

a mounting base frame attached removably to said front side of the drive frame and adapted to be driven transversely and longitudinally together with said drive frame;

a support frame connected to said mounting base frame such that said support frame is driven with said mounting base frame longitudinally but not transversely;

a rotary frame supported rotatably on said support frame;

a headgear frame fitted removably on said rotary frame for clamping a headgear; and a rotation converting member interposed between said mounting base frame and said rotary frame for converting the transverse motions of said mounting base frame into rotations of said rotary frame, wherein said mounting base frame includes a guide face confronting a drive frame front face of said drive frame from the front and extending transversely, and wherein one or more front bearing roller for abutting against said guide face and one or more rear bearing roller for abutting against said drive frame front face are rotatably borne on said support frame respectively.

2. A headgear frame apparatus according to claim 1, further comprising:

a roller span adjusting means for holding said front bearing roller and said rear bearing roller with their pivot pins having a longitudinal span expanded, to bring said front bearing roller and said rear bearing roller individually into abutment without any looseness against said guide face and said drive frame front face.

3. A headgear frame apparatus according to claim 2, wherein said roller span adjusting means includes: an adjusting lever supporting the pivot pin of said front bearing roller or said rear bearing roller and hinged turnably to said support frame; and lever holding members for stopping and holding said adjusting lever at the rotation adjusted position on said support frame.

4. A headgear frame apparatus according to claim 3, wherein said adjusting lever is so disposed that it can be manipulated by an operator from the front of said headgear frame apparatus.

5. A headgear frame apparatus according to claim 2, wherein said roller span adjusting means is one or more spring for urging both or one of the pivot pins of said front bearing roller and said rear bearing roller in a direction to expand the longitudinal span of both pivot pins.

6. A headgear frame apparatus according to claim 1, wherein one of said one or more front bearing roller and said one or more rear bearing roller is provided by one roller whereas the other is provided by two or more rollers.

7. A headgear frame apparatus according to claim 1, wherein both of said one or more front bearing roller and said one or more rear bearing roller are provided by said two or more rollers respectively.

* * * * *